US011904218B2

(12) United States Patent
Mickles

(10) Patent No.: US 11,904,218 B2
(45) Date of Patent: Feb. 20, 2024

(54) METHOD FOR MEASURING A PLAYER'S SWING TIME

(71) Applicant: Joshua Mickles, San Diego, CA (US)

(72) Inventor: Joshua Mickles, San Diego, CA (US)

( * ) Notice: Subject to any disclaimer, the term of this patent is extended or adjusted under 35 U.S.C. 154(b) by 25 days.

(21) Appl. No.: 17/833,470

(22) Filed: Jun. 6, 2022

(65) Prior Publication Data

US 2022/0387868 A1 Dec. 8, 2022

Related U.S. Application Data

(60) Provisional application No. 63/196,767, filed on Jun. 4, 2021.

(51) Int. Cl.
*A63B 69/00* (2006.01)

(52) U.S. Cl.
CPC .. *A63B 69/0002* (2013.01); *A63B 2069/0008* (2013.01); *A63B 2214/00* (2020.08); *A63B 2220/62* (2013.01)

(58) Field of Classification Search
CPC ..... A63B 69/0002; A63B 2069/0008; A63B 2214/00; A63B 2220/62; A63B 69/0053
USPC ..... 473/417, 422, 431, 451, 453, 461
See application file for complete search history.

(56) References Cited

U.S. PATENT DOCUMENTS 5,984,810 A * 11/1999 Frye ..... A63B 69/0002 473/422
7,575,526 B2 * 8/2009 Husband ..... A63B 69/0002 473/456
7,892,116 B2 * 2/2011 Kellogg ..... A63B 69/0002 473/422
2020/0222782 A1 * 7/2020 Cherryhomes .... A63B 69/0002

OTHER PUBLICATIONS

PACT Club Timer III, https://www.amazon.com/PACT-Club-Shot-Timer-3/dp/B00PGIL974, Nov. 6, 2023.

* cited by examiner

*Primary Examiner* — Nini F Legesse
(74) *Attorney, Agent, or Firm* — Cislo & Thomas, LLP

(57) ABSTRACT

A method for improving a player's performance, such as reaction time or swing time by measuring the time it takes a player to change from a load position to a swing position where the player's bat makes contact with the ball when presented with a stimulus emitted from a timer. This method measures the time elapsed by utilizing a timer that configured to emit a stimulus, such as an audible sound, receive an external stimulus, such as the sound of the player's bat making contact with the ball, record the time elapsed, and present the time on a display.

19 Claims, 2 Drawing Sheets

TIMER 100

TIMER 100

METHOD FOR MEASURING A PLAYER'S SWING TIME

CROSS-REFERENCE TO RELATED APPLICATION

This patent application claims the benefit of U.S. Provisional Patent Application Ser. No. 63/196,767, entitled "Method of Measuring a Player's Reaction Time and Improving Perception," filed Jun. 4, 2021, which application is incorporated in its entirety here by this reference.

TECHNICAL FIELD

This invention relates to a method of measuring a player's performance, such as swing time.

BACKGROUND

It is essential as a player to develop speed in swinging a bat to to make contact with the ball. The faster a player can swing the barrel of the bat from a load position into the contact zone and make contact with the ball (i.e., swing speed) when pitched, the less likely the player will strike out. For example, a 95 MPH ball arrives at the plate between about 0.43 to about 0.46 seconds depending on release point. If a player can get his or her bat into the contact zone in about 0.30 seconds, the player has about 0.16 seconds or about 22 feet to actually see and recognize a pitch before having to make a decision whether to swing. If a player cannot swing faster than about 0.46 seconds, it can be declared with relative certainty that the player will have to guess at the pitch because his physical ability is not capable enough to catch up to a 95 MPH fast ball even if his or her brain can see and register it fast enough.

Therefore, there is a need for a device and method for improving a player's reaction time and improving a player's swing speed.

SUMMARY

The method of measuring a baseball or softball player's swing time measures the speed in which a player can react and get the barrel of his or her bat into the contact zone and make contact with a ball on a tee. This drill requires the use of a timer which allows the coach, another player, or the player to control when the player swings a bat (i.e. reaction time), and record how fast he or she was able to do so (i.e., the swing time). This method is important because at some point during a pitch a player's brain makes the decision to swing or not to swing and that decision has to be relayed to the motor neurons that trigger the player's body to swing. This method records the time it takes for that process to happen. This method allows for the determination of how fast a player can get the barrel of a bat into the contact zone which shows how much time the player takes to process a pitch before having to make the decision to swing.

These and other features, aspects, and advantages of the present invention will become better understood with reference to the following description.

DETAILED DESCRIPTION OF THE INVENTION

The detailed description set forth below is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The present invention is directed towards a method of measuring a player's swing time in an attempt to improve reaction time and swing time by measuring the time it takes when the player is presented with a stimulus until the player's bat makes contact with a ball, using a timer that starts a clock when the stimulus is emitted, and stops the clock when the sound of the bat hitting the ball is detected.

Figure 2:
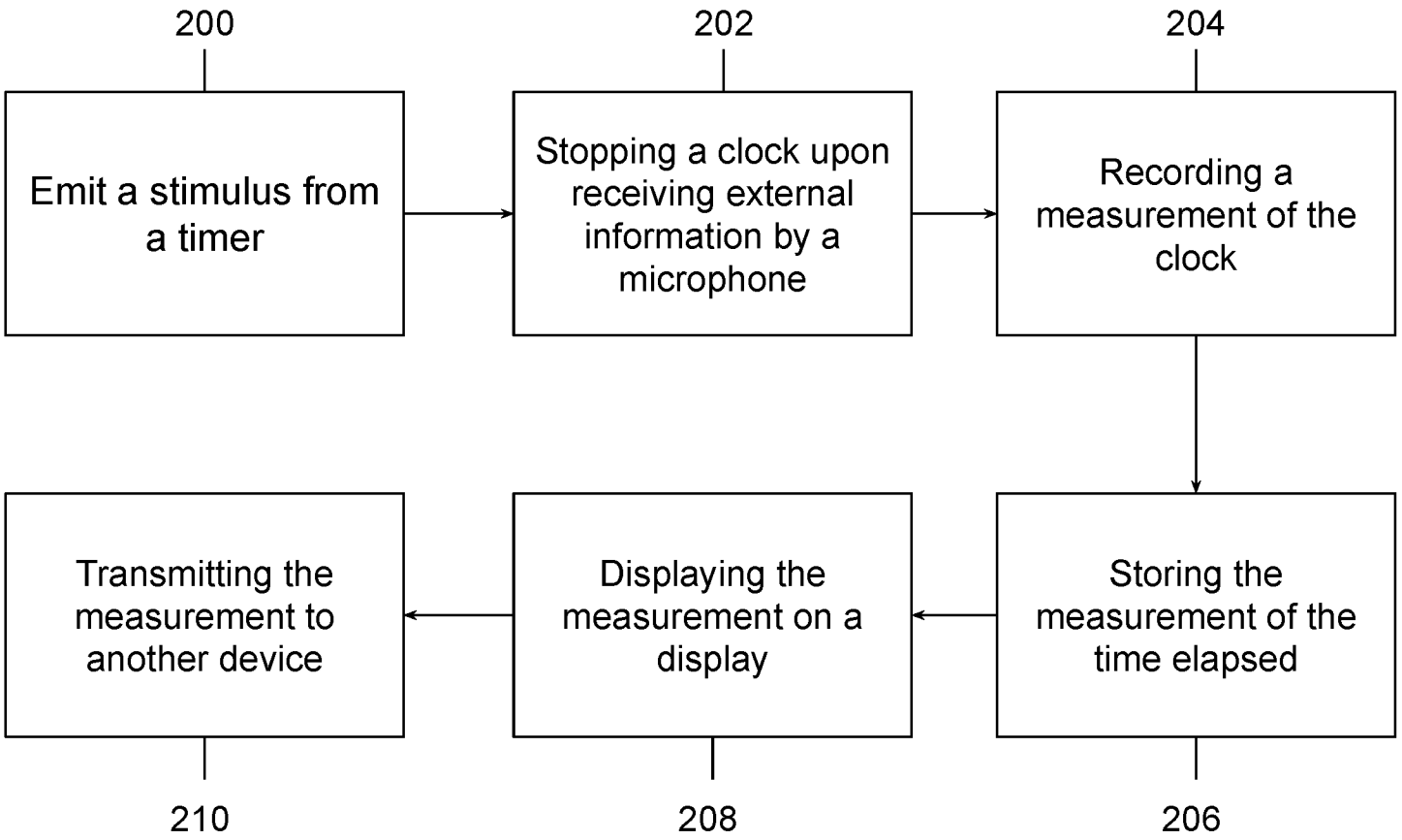
FIG. 2 shows a flow diagram of an embodiment of the present invention.

With reference to FIG. 2, the method comprises the steps of: (a) emitting a stimulus from a timer 200; (b) stopping a clock on the timer upon receiving an external information by a microphone 202; and (c) displaying a measurement of time on a display of the timer 208, whereby the reaction time and swing time of the user is measured.

The timer 100 includes a timing device, such as a clock 102, that can measure the passage of time, preferably on the order of one-tenth, one-hundredth, or one-thousandth of a second. The clock 102 is configured to be started, stopped, and reset, as in typical stop watches. The timer can be configured to emit the stimulus and simultaneously start the clock 102 upon actuation by the user. The timer 100 can also be configured to automatically emit a stimulus and simultaneously begin measuring time after a period of delay. The period of delay can be specified by the user such as by the use of a countdown mechanism. The period of delay can also be randomized so that the user cannot anticipate or approximate when the stimulus will be emitted. In other words, the user can select a random delay function so that the timer 100 randomly selects the countdown time to when the timer 100 emits the stimulus and simultaneously starts the clock 102.

The clock 102 is configured to stop measurement when a desired action is completed. For example, the completion of a desired action is determined when the timer 100 receives external information. In the example of measuring the reaction time and speed of a batter's swing, the external information can be the sound of a bat making contact with a ball. As such, the timer 100 can be configured with a microphone 106 operatively connected to the clock 102, such that sound picked up by the microphone 106 stops the clock 102.

The clock 102 may be directed to be shut off and cease measurement. The clock 102 may also be reset to be re-zeroed to begin taking measurement at time zero when a new stimulus is emitted.

The clock 102 includes a device that is enabled to record information such as time elapsed. The time measured by the clock 102 is capable of being displayed on the face of the timer 100 or may as well be displayed on a screen for purposes of larger viewing, or transmitted to any other device 210 such as a computer, smart phone, tablet, and the like.

The clock 102 must be capable of emitting a stimulus such as with a signal generator. The stimulus includes but is not limited to an audible or visual stimulus emitted from the timer 100. The stimulus may be emitted by a speaker 104, a light source 108, a mechanical device 110 that generates movement, such as a flag, rod, peg, lid, or the like, flipping up or popping outwardly, or any other device that can notify the user that the clock 102 has started. Simultaneously, as the stimulus is emitted (e.g., sound, light, or movement generated) from the timer 100, the clock 102 will begin to measure the time that elapses from when the stimulus is emitted until the external information is received. Depending on whether the stimulus is audible or visual, the stimulus can be adjusted for sensitivity control including but not limited to adjustments for volume, brightness, or extent of movement.

The external information received by the timer 100 can be received through a microphone 106 in the timer 100 or any similar mechanism capable of receiving audio input. The microphone 106 can be adjusted for sensitivity to audio input such as adjusting the decibel level required to be detected by the microphone 106. This adjustment can filter out potential ambient noise so that the clock 102 is not stopped prematurely by the incorrect external information. For example, the sensitivity of the microphone can be set to detect sounds of approximately 50 decibels or higher. Preferably, the sensitivity of the microphone can be set between approximately 60 decibels to approximately 140 decibels. More preferably, the sensitivity of the microphone can be set between approximately 70 decibels to approximately 120 decibels or any decibel therebetween. Once the sound input level is adjusted, a receipt of external information at the decibel set stops the clock 102.

The timer 100 can internally record the measurement period 204 from the start of the clock 102 when the stimulus is emitted until the clock 102 stops when the external information is received, and store the information 206 through a memory mechanism in the timer 100. Upon reset of the clock 102, the previous measurement can be stored within the timer for later review by the user. The internal memory of the timer 100 can be reset and erased upon direction of the user.

The measurement recorded and stored within the timer 100 can be displayed on the face of the timer 100 upon completion of the measurement, on a screen for purposes of larger viewing, or sent to a computing device for storage, processing, or further transmission to other devices.

In one example of the invention, the method of the invention measures a player's reaction time and in turn, to help improve the speed of the player's swing. The timer 100 is used to measure when the player swings to make contact with a ball and record how fast the player is able to do so. Where another user is present with the timer 100, the observing user can activate the timer 100 after the player user is in a load position at a plate or in a batter's box with a ball on a tee nearby. Activation of the timer 100 will immediately emit the stimulus and simultaneously start the clock 102, or will emit the stimulus and simultaneously start the clock 102 after a predetermined or randomized delay so that the player user cannot anticipate when the clock 102 starts.

The randomized delay is also useful when the player user is training alone. If the player user is alone, he or she may activate the timer 100 first, then enter into his or her load position, and wait for the stimulus to be emitted. Having the predetermined or randomized display will allow the player sufficient time to enter into his or her load stance before the stimulus is emitted. Once the stimulus is emitted, the clock 102 simultaneously begins measurement of the time elapsed from the time the stimulus is emitted until the external information is received, i.e. the sound of the bat hitting the ball.

Upon perceiving the stimulus, the player then swings the bat to hit the ball as fast as possible. The clock 102 stops measurement upon receipt of the sound of the player's bat making contact with the ball. The time elapsed from the stimulus being emitted and the player's bat making contact with the ball can be displayed on the timer 100. This time measurement can also be displayed on a nearby screen for larger viewing or transmitted to other devices, such as a computer, phone, server, website, and the like. Upon a user or player's reset of the time, the timer's 100 internal memory keeps track of the last measurement for later viewing and reset the timer to be started again from zero. The user or another individual present can record the times using a data sheet. This process may be repeated, for example, up to 20 times. Each time the process is repeated, the player is encouraged to adjust his or her load position including feet position, bat position, hip position, etc. The goal is for the player to adjust his or her position in order to decrease the time elapsed from the time the player receives the stimulus emitted from the timer 100 to the time the player swings the bat and makes contact with the ball on the tee. It may also be possible for the tee to be moved to various locations around the plate in order to emulate a pitcher's inside pitch, outside pitch, pitch in front, etc. If an observer user, such as a coach, is present with the timer 100, the observer user should not provide any feedback to the player in order for the player to determine what load position will allow for the shortest elapsed time for the player to swing and make contact with the ball on the tee upon receipt of the stimulus emitted from the timer 100.

In some embodiments, a camera 112, such as a slow motion camera (i.e. any camera capable of capturing video for playback in slow motion) can be set up for post analysis of the player's swing mechanics to improve the player's timing and/or determine the player's reaction time to the stimulus. In some embodiments, the camera 112 can ge integrated into the timer 100. The camera 112 can be programmed to start recording seconds prior to when the stimulus is emitted so that the player's positioning can be recorded prior to swinging the bat. In some embodiments, an external camera 112 can be used in which, the camera 112 can be positioned so that the player and the timer's 100 display can be visible. With the addition of the camera 112, a player's reaction time can be measured, i.e., the time it takes for the player to perceive the stimulus to when the player starts the physical movement involved in swinging the bat. In addition, the player's swing time can also be measured, i.e., the time the player's movement begins to the time it takes for the player's bat to make contact with the ball. The combination of these two measurements provide the total time it takes for a player to make contact with ball after being presented with a stimulus. Having this information allows the player to track and improve his or her performance. The camera 112 can be configured to automatically start recording prior to the step of emitting the stimulus and continue recording after the step of stopping the clock so that the player's load position before swinging the bat, and the player's position after swinging the bat can be captured.

Figure 1:
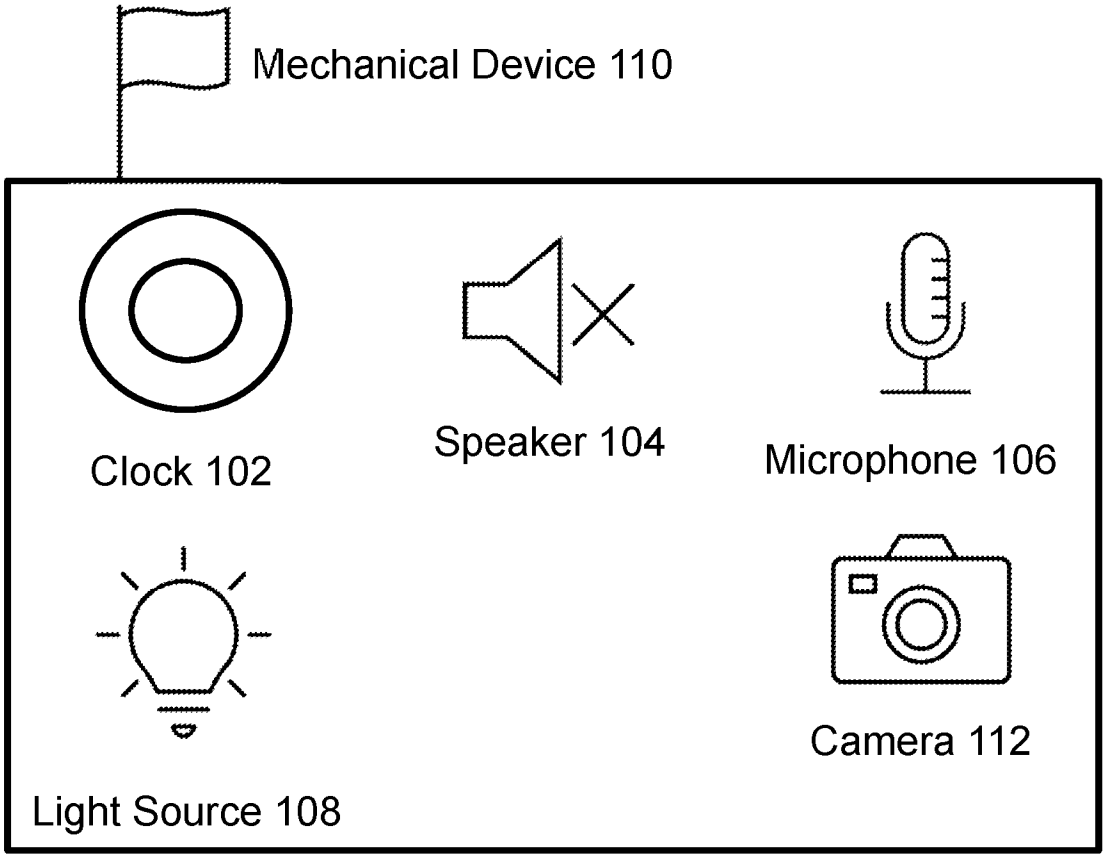
FIG. 1 shows a schematic diagram of an embodiment of the present invention.

The timer 100 of the present invention can be embodied in a stand alone device as shown in FIG. 1, with any combination of the various features disclosed herein. For example, the timer 100 can comprise a clock 102, a microphone, and one or more of the stimulus emitters, such as the speaker 104, the light source 108, and/or the mechanical device 110. Optionally, the timer 100 can comprise a camera. As such, although FIG. 1 shows all of these features in a single device, not all features are required on a single device, rather, these features are all shown together for illustrative purposes only, and not shown as a specific limitation. In some embodiments, the system can be an app implemented in a smart phone, tablet, or computer to utilize the clock, speaker, microphone, and camera on the smart phone to execute the steps of the present invention as described herein.

The system can take the form of an entirely hardware embodiment, an entirely software embodiment or an embodiment containing both hardware and software elements. In one embodiment, the system can be implemented in software, which includes but is not limited to firmware, resident software, microcode, etc. Furthermore, the system can take the form of a computer program product accessible from a computer-usable or computer-readable medium providing program code for use by or in connection with a computer or any instruction execution system.

As such, the present invention encompasses a system, such as a computing device, a computer program product, a computer-implemented method, and/or a computer readable medium containing instructions executable on a computing device, or any combination thereof, to perform the functions described herein. As such, the system can comprise at least one processor; a graphical user interface (GUI); and a memory operatively coupled to the processor, the memory storing program instructions that when executed by the processor, causes the system to (a) emit a stimulus from a timer and simultaneously starting a clock to measure a time; (b) stop the clock upon receiving an external information by a microphone; and (c) display the time on a display of the timer, among other features described herein.

For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium comprise a semiconductor or solid-state memory, magnetic tape, a removable computer diskette, a random access memory (RAM), a read-only memory (ROM), a rigid magnetic disk and an optical disk. Current examples of optical disks comprise compact disk-read only memory (CD-ROM), compact disk-read/write (CD-R/W) and DVD.

A data processing system suitable for storing and/or executing program code comprises at least one processor coupled directly or indirectly to memory elements through a system bus. The memory elements can include local memory employed during actual execution of the program code, bulk storage, and cache memories that provide temporary storage of at least some program code in order to reduce the number of times code is retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Described above, aspects of the present application can be embodied in a World Wide Web ("WWW") or ("Web") site accessible via the internet. As is well known to those skilled in the art, the term "Internet" refers to the collection of networks and routers that use the Transmission Control Protocol/Internet Protocol ("TCP/IP") to communicate with one another. The internet can include a plurality of local area networks ("LANs") and a wide area network ("WAN") that are interconnected by routers. The routers are special purpose computers used to interface one LAN or WAN to another. Communication links within the LANs may be wireless, twisted wire pair, coaxial cable, or optical fiber, while communication links between networks may utilize 56 Kbps analog telephone lines, 1 Mbps digital T-1 lines, 45 Mbps T-3 lines or other communications links known to those skilled in the art.

Furthermore, computers and other related electronic devices can be remotely connected to either the LANs or the WAN via a digital communications device, modem and temporary telephone, or a wireless link. It will be appreciated that the internet comprises a vast number of such interconnected networks, computers, and routers.

As is appreciated by those skilled in the art, the WWW is a vast collection of interconnected or "hypertext" documents written in HTML, or other markup languages, that are electronically stored at or dynamically generated by "WWW sites" or "Web sites" throughout the Internet. Additionally, client-side software programs that communicate over the Web using the TCP/IP protocol are part of the WWW, such as JAVA.RTM. applets, instant messaging, e-mail, browser plug-ins, Macromedia Flash, chat and others. Other interactive hypertext environments may include proprietary environments by online service providers, as well as the "wireless Web" provided by various wireless networking providers, especially those in the cellular phone industry. It will be appreciated that the present application could apply in any such interactive communication environments, however, for purposes of discussion, the Web is used as an exemplary interactive hypertext environment with regard to the present application.

A website is a server/computer connected to the Internet that has massive storage capabilities for storing hypertext documents and that runs administrative software for handling requests for those stored hypertext documents as well as dynamically generating hypertext documents. Embedded within a hypertext document can be a number of hyperlinks, i.e., highlighted portions of text which link the document to another hypertext document possibly stored at a website elsewhere on the Internet. Each hyperlink is assigned a URL that provides the name of the linked document on a server connected to the Internet. Thus, whenever a hypertext document is retrieved from any web server, the document is considered retrieved from the World Wide Web. Known to those skilled in the art, a web server may also include facilities for storing and transmitting application programs, such as application programs written in the JAVA.RTM. programming language from Sun Microsystems, for execution on a remote computer. Likewise, a web server may also include facilities for executing scripts and other application programs on the web server itself.

A remote access user may retrieve hypertext documents from the World Wide Web via a web browser program. A web browser is a software application program for providing a user interface to the WWW. Upon request from the remote access user via the web browser, the web browser requests the desired hypertext document from the appropriate web server using the URL for the document and the hypertext transport protocol ("HTTP"). HTTP is a higher-level protocol than TCP/IP and is designed specifically for the requirements of the WWW. HTTP runs on top of TCP/IP to transfer hypertext documents and user-supplied form data between server and client computers. The WWW browser may also retrieve programs from the web server, such as JAVA applets, for execution on the client computer. Finally, the WWW browser may include optional software components, called plug-ins, that run specialized functionality within the browser.

Data collected using the system and methods disclosed herein can be used to share with others using apps, the intenet, websites, and the like, in an effort to improve the player's overall abilities.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A method of measuring a reaction time and a swing time of a user by measuring a speed in which the user can react and swing a bat into a contact zone and make contact with a ball, comprising the steps of:

a) emitting a stimulus from a timer,
   i) wherein the timer comprises a clock for measuring time, and a microphone for receiving an external information,
   ii) wherein the clock starts measuring time automatically when the stimulus is emitted,
   iii) wherein the stimulus is selected from the group consisting of an audible signal and a visual signal, and
   iv) wherein the stimulus is adjustable for sensitivity control;

b) stopping the clock upon receiving the external information by the microphone,
   i) wherein the external information is a sound of the bat making contact with the ball,
   ii) wherein the microphone is adjustable for sensitivity to audio input to filter out ambient noise so that the timer is not stopped prematurely by the ambient noise,
   iii) wherein the sensitivity of the microphone detects sounds of approximately 50 decibels to approximately 140 decibels, and
   iv) wherein the timer comprises a reset to re-zero the clock to begin taking measurement at time zero when a new stimulus is emitted;

c) recording a measurement of the clock, wherein the measurement is the period of time elapsed from the step of emitting the stimulus from the timer to the step of stopping the clock;

d) storing the measurement of the time elapsed to a memory in the timer;

e) displaying the measurement on a display of the timer, wherein the timer displays the measurement of the period of time elapsed from the step of emitting the stimulus from the timer to the step of stopping the clock; and f) transmitting the measurement to another device, whereby the reaction time and the swing time of the user is measured.

2. A method of measuring a reaction time and swing time of a user by measuring a speed in which the user can react to a stimulus and swing a bat into a contact zone and make contact with a ball, the method comprising the steps of: (a) emitting the stimulus from a timer and simultaneously starting a clock to measure a time; (b) stopping the clock upon receiving an external information by a microphone; and (c) displaying the time on a display of the timer, whereby the reaction time and swing time of the user is measured.

3. The method of claim 2 wherein the stimulus is selected from the group consisting of an audible signal and a visual signal.

4. The method of claim 3 wherein the stimulus is emitted after a period of delay from when the timer is actuated.

5. The method of claim 3 wherein the timer is configured to allow the user to set the period of delay.

6. The method of claim 3 wherein the period of delay is randomized such that the user cannot anticipate when the stimulus will be emitted.

7. The method of claim 3 wherein the external information is a sound of the bat making contact with the ball.

8. The method of claim 7 wherein the microphone is adjustable for sensitivity to audio input to filter out ambient noise so that the timer is not stopped prematurely by the ambient noise.

9. The method of claim 8 wherein the sensitivity of the microphone is set to detect sounds of approximately 50 decibels to approximately 140 decibels.

10. The method of claim 9 wherein the timer comprises a reset to re-zero the clock to begin taking measurement at time zero when a new stimulus is emitted.

11. The method of claim 10 wherein the step of displaying the measurement on the display of the timer, wherein the measurement is the period of time elapsed from the step of emitting the stimulus from the timer to the step of stopping the clock.

12. The method of claim 11 further comprising the step of recording the measurement from the timer.

13. The method of claim 12 further comprising the step of storing the measurement of the time elapsed to a memory in the timer.

14. The method of claim 13 further comprising the step of transmitting the measurement to another device.

15. The method of claim 3 wherein the stimulus is a sound emitted by a speaker on the timer.

16. The method of claim 3 wherein the stimulus is a light source on the timer.

17. The method of claim 3 wherein the stimulus is movement of a mechanical device on the timer.

18. The method of claim 3 wherein the timer further comprises a camera.

19. The method of claim 18, wherein the camera automatically starts recording prior to the step of emitting the stimulus and continues to record after the step of stopping the clock.

* * * * *